US007311467B2

(12) United States Patent
Moore, Jr.

(10) Patent No.: US 7,311,467 B2
(45) Date of Patent: Dec. 25, 2007

(54) ERGONOMIC SIZE LEACHING CHAMBER

(75) Inventor: Roy E. Moore, Jr., Killingworth, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 209 days.

(21) Appl. No.: 10/677,770

(22) Filed: Oct. 1, 2003

(65) Prior Publication Data

US 2005/0074288 A1 Apr. 7, 2005

(51) Int. Cl.
*E02B 11/00* (2006.01)

(52) U.S. Cl. ..... 405/46; 405/43; 405/44; 405/45; 405/49

(58) Field of Classification Search ..... 405/43–51
See application file for complete search history.

(56) References Cited

U.S. PATENT DOCUMENTS 4,759,661 A * 7/1988 Nichols et al. ..... 405/48
5,017,041 A * 5/1991 Nichols ..... 405/48
5,419,838 A 5/1995 DeTuillo
5,511,903 A * 4/1996 Nichols et al. ..... 405/43
5,556,231 A * 9/1996 Sidaway et al. ..... 405/48
5,588,778 A * 12/1996 Nichols et al. ..... 405/48
5,669,733 A * 9/1997 Daly et al. ..... 405/48
5,890,838 A 4/1999 Moore et al.
5,924,821 A * 7/1999 Hansen et al. ..... 405/129.57
6,698,975 B1 * 3/2004 Benecke ..... 405/43
2002/0025226 A1 2/2002 Maestro
2002/0044833 A1 * 4/2002 Kruger et al. ..... 405/43
2003/0219310 A1 * 11/2003 Burnes et al. ..... 405/39
2004/0184884 A1 * 9/2004 DiTullio ..... 405/43
2005/0074287 A1 * 4/2005 Brochu et al. ..... 405/43
2005/0111915 A1 * 5/2005 Moore et al. ..... 405/46

OTHER PUBLICATIONS

"The Orignal Reln Drain Treching" 2 Page Brochure Reln Plastics Co. (Date Unknown).
J. Burgess"Designing for Humans" Petrocelli Books (1986) pp. 8-11, 46-47, 64-65.
Infiltrator Systems Inc, "The Equalizer 24 Chamber" (4) Page Brochure (1995).
Cultec Inc, "Recharger and Contactor" (4) Page Brochure (2000).
Stormtech, LLC, "Isolator Row O & M Manual" (4) Page Brochure (2004).
Infiltrator Systems Inc, "Storm Water Management System Installation", (4) Page Brochure (1989).
Infiltrator Systems, Inc "The High Capacity H-20 Infiltrator Stormwater Chamber System" (8) Page Brochure(1998).

* cited by examiner

*Primary Examiner*—Frederick L. Lagman
(74) *Attorney, Agent, or Firm*—C Nessler

(57) ABSTRACT

A leaching chamber, particularly a chamber which lacks ribs and is therefore flexible along its length, has a length in the range 4 to 5 ft, a length to width aspect ratio of between 1.2 and 1.6 and a weight of less than 3 pounds per foot, preferably about 12 pounds for a 4 ft chamber. Since the chamber length is less and the mass is more favorably concentrated, handling of chambers, and installing chambers in trenches is improved. The ability of a string of interconnected chambers to curve is increased.

11 Claims, 3 Drawing Sheets

ERGONOMIC SIZE LEACHING CHAMBER

TECHNICAL FIELD

The present invention relates to leaching chambers, which are buried underground to receive and disperse waters.

BACKGROUND

Molded plastic leaching chambers having arch shape cross section and slotted sidewalls are buried in soil, to receive wastewater, such as from a septic tank, so the water can be percolated into the soil. A popular configuration of widely used chamber is about 6 ft long, about 3 ft wide and 1 to 1.5 ft high. Some specialty chambers, favored for drier and sandier soils are narrower and longer, at about 8 feet. Chambers are connected together at joints, to form a string of chambers within a trench, and then covered with soil or other media. Because water usually flows by gravity into and through a string of chambers, a string must be very close to level. So, the bottom of the trench is prepared accordingly, usually with a mechanical trencher.

To create the string, chambers are sequentially placed in a trench, which is slightly wider than the chamber width. Typically, chambers interlock together to with some kind of load-transferring inter-chamber joints, as by means of overlapping male and female flanges. See U.S. Pat. No. 5,336,017. Installing the string requires some skill and practice. Typically, a worker cants a second chamber upwardly, as he stands in the empty part of the trench, just beyond a previously installed first chamber. He seeks to engage the features at the first end of the second chamber with the mating details at the end of the first chamber. With the chambers partially engaged, he angles down the second end of the second chamber to a level position, while applying lateral pressure to keep the joint together. The installer's vision of the joint is often impaired by the bulk of the chamber, as the installer has to move down the narrow trench while lowering the chamber into the space he vacates.

The typical 6 foot long by 3 foot wide chamber typically weighs 25-40 pounds. It is thus bulky and awkward to handle. Problems with installing chambers arise, particularly when weather conditions are poor or the worker is impatient or unskilled. The trench may be irregular, with sides that are prone to shedding soil and stones into the trench, should the installer hit a side of the trench. Soil falling into the trench can upset the careful leveling of the trench bottom; and, even a small amount of soil can become captured within the joint, upsetting good engagement. Such problems either slow the work or cause the worker to do remedial work. Sometimes, chambers have to be removed so the trench can be re-leveled. Adding an assistant is undesirable because of increase in labor cost. Whenever there are awkward and repetitive motions, or a worker is irritated, there is a potential risk of injury, which one would want to avoid. Lumbar injuries are most associated with lifting bulky or heavy objects at extreme distances from the body. See the book "Designing for Humans", referenced below. Thus, one aim of the present invention is to ease installation and reduce labor costs.

Another need, which arises when installing chambers, is to make the chambers follow a curved path in the horizontal plane. Sometimes, the contour of a slope must be followed, or minor obstructions lie along a straight path. Prior art chambers with ordinary joints designed for essentially linear strings have a some angular flexibility. For instance, a plus or minus 3 degree bend might be achieved in a joint which is basically intended for straight line connection. See U.S. Pat. No. 5,336,017 of Nichols. There are prior art chambers with angled ends. See U.S. Pat. No. 5,588,778 of Nichols et al. But such chambers are basically suited for fixed large angle changes; and, using them presents inventory problems in the manufacturing and distribution system. They have not been favored in commerce. Swivel connections for chambers are known, to address the need. For instance, a joint between chambers running at between plus or minus 10 degrees might be created. See commonly owned U.S. patent application Ser. No. 10/442,810 of J. Burnes et al., filed May 20, 2003 and U.S. Pat. No. 6,592,293 to Hedstrom et al. While such chambers are useful, they add a complexity to the structural design and manufacture. So, it is an aim to alternatively provide for angular variations in the horizontal plane. Additionally, the bottom of the trench may not be precisely planar, and the same limitations and needs apply to vertical plane angling of chambers.

Another problem associated with certain chambers is that chambers are nested for transport, and are difficult to unstack, at the point of use. Lifting one end of a chamber unevenly with the other end, when seeking to remove the chamber from a nested stack, can cause jamming and resistance to separating. Common chambers cannot be grasped and lifted evenly at both ends by an ordinary worker, because of the chamber size compared to work arm spread. So, an undesirable result is that two workers may be required, to lift both ends of a 6 foot long chamber from a stack.

Generally, the ability of a worker to handle chambers depends on the size of the worker relative to the chamber or other article being handled. Women, who are on average smaller and less strong than men, are more commonplace nowadays in construction and other mechanical trades. So, it is a general object to accommodate them, by improving the manner in which inherently large awkward objects can be handled.

SUMMARY

In accord with the invention, a leaching chamber is provided with a length which is substantially shorter than chambers in the prior art. The length is more suited to the capabilities of a typical worker to handle; and thus, the invention chamber is referred to as an Ergonomic Length Chamber, or ELC.

In accord with the invention a leaching chamber has a length between about 4 ft and about 5 ft, preferably about 4 ft, and less than 100 percent of the mean height of an American male (and his associated ability to grasp an object with outstretched arms). Thus, a chamber can be removed from a nested stack by one worker grasping both ends, and is easier to manipulate when installing as part of a string, as described in the Background. Preferably, an ELC chamber has a length to width aspect ratio of between 1.2 and 1.6, compared to aspect ratios of 2 and more in the prior art, and thus the mass is more concentrated and the chamber is easier to manipulate; and, the chamber weight is less than about 3 pounds per foot, or about 12 pounds for a 4 ft chamber.

In further accord with the invention, a string of leaching chambers, wherein chamber length is between 4 and 5 ft and the chamber joint is configured for linear connection, has increased curve factor, i.e., increased ability of a string to bend, preferably more than 0.57 degrees per foot of chamber length, owing to the increased number of chambers in a given length string.

In further accord with the invention, a chamber has a continuous arch shape curve cross section, and closely spaced corrugations which are free of internal and external ribbing, a length of 4-5 ft and a flexibility factor of greater than about 1 inch. The lack of ribbing also makes the chamber more flexible along its length, so it is more difficult to control the position of the end of a chamber, when a worker manipulates the chamber in a trench during installation.

In still further accord with the invention, a leaching chamber has a length of 4 to 5 ft and less than 100% of the height of a mean American male or female; and, thus nested chambers can be lifted from a stack by a person's grasp at both ends of the chamber.

The invention chamber is more easily handled before installation, at point of manufacture and when being removed from a nested stack. It is more easily manipulated when being joined to another like chamber in a trench. The chamber provides other benefits, described below.

The foregoing and other objects, features and advantages of the invention will become more apparent from the following description of preferred embodiments and accompanying drawings.

DESCRIPTION

The present invention is described and claimed in terms of arch shape cross section injection molded thermoplastic leaching chambers, both of the prior art type and of a newly introduced lightweight rib free type. The chambers have a multiplicity of small perforations, typically slots running lengthwise along the chamber sidewall, so water inside the chamber can percolate into surrounding soil. In the present invention, chambers are made shorter than chambers in the prior art, and are between 4 and 5 ft long. Typically they are about 3 ft wide. They are referred to as ELC chambers, an acronym for an Ergonomic Length Chamber. An ELC chamber reduces labor in several respects.

Figure 4:
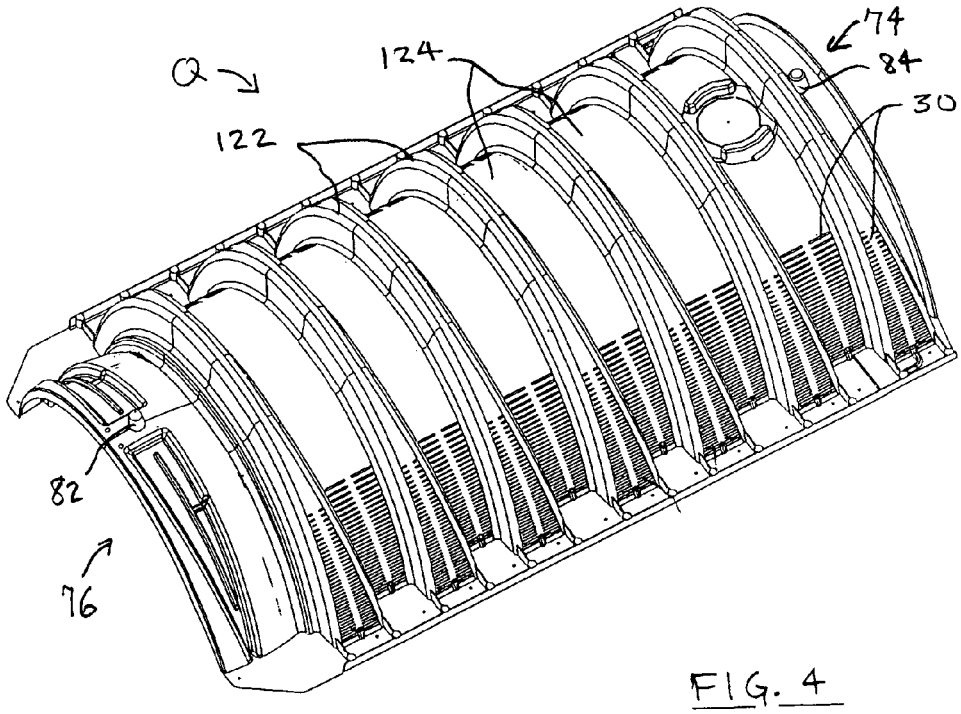
FIG. 4 is an isometric view of a leaching chamber of the present invention, which is commercially designated the Quick4™ leaching chamber.

A convention in describing leaching chamber length, used herein, is that it means the effective length. Effective length is the increment of length which a chamber represents when part of a chamber string is interconnected by joints. Thus, the about 4 ft chamber Q referred to here and shown in FIG. 4 is about 53 inch overall. Since, in a string each such chamber Q overlaps its mating chamber by about 5 inch at the joint, the length (i.e., effective length) of chamber Q is 48 inch.

A preferred embodiment ELC chamber, chamber Q, has several new features, subject of other patent applications, as described further below. Compared to the prior art chambers, it is shorter at 4 ft, it has a continuous arch shape curve, smaller pitch corrugations, substantially thinner and variable thickness perforated sidewalls, variable height slots, and much lower weight. Chamber Q joints comprise a dome shape portion and allow up to plus or minus 10 degrees of angling between the chambers. Another embodiment of the invention, embodies mostly prior art. It has features, including arch shape and male/female overlapping/overlapped latching type end joint detail which are characteristic of widely sold commercial chambers, such as Infiltrator brand chambers (Infiltrator Systems, Inc., Old Saybrook, Conn., US). The features of such chambers have been described in various patents, including U.S. Pat. No. 5,336,017 and U.S. Pat. No. 5,551,903, the disclosures of which, about chamber features and configuration, are hereby incorporated by reference.

Figure 3:
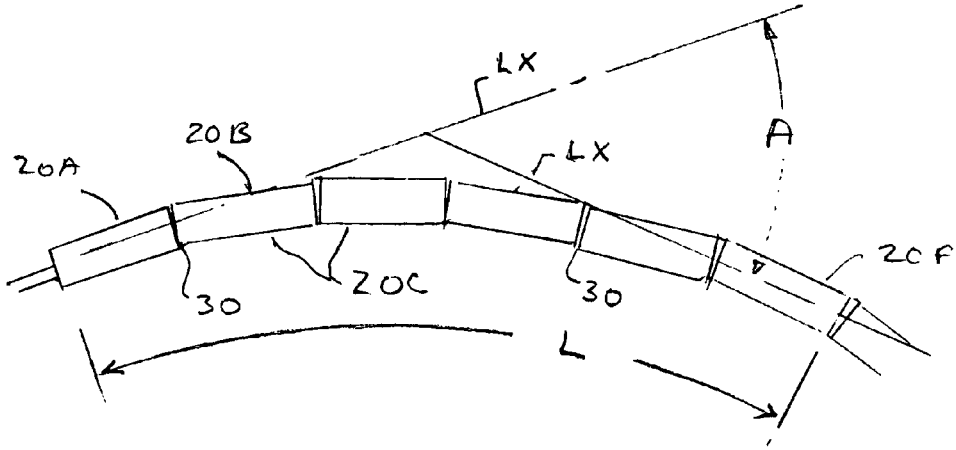
FIG. 3 is a schematic plan view of a chamber string, showing how the string bends in the horizontal plane due to angling at the joints.

Chamber joints transfer vertical loads between the mated chambers and resist lengthwise separating or compressing loads. Chambers with an older latching type joint transfer loads both to and from a given chamber, and are intended for essentially linear (straight line) interconnection of chambers. A new chamber Q joint mostly transfers load from the overlapping chamber. A characteristic of such chambers and joints is that, through looseness of fit, they allow up to plus or minus 3 degrees of angling from parallel alignment of the longitudinal axes LX of the chambers. Thus, a gradual curve, having a total turning angle A, as illustrated by the plan view of chambers 20 in FIG. 3 can be achieved by a string of interconnected chambers having length L.

In the present invention, for a given length of chamber string, there are more joints than in a string of prior art chambers. There is thus improved capability to curve horizontally. For instance, if the string length is 100 ft, and ELC chamber length is 4 ft, and each joint allows 3 degree angling, the maximum curving angle is about 72 degrees, with 24 joints. For a string of prior art chambers which are 6.25 ft long, there are 15 joints and the maximum curving angle A is about 45 degrees. Thus, there is 60% more curving with 56% more chambers.

The ability of a chamber string to curve in the horizontal plane can be described in terms of a "curve factor", that is the curve angle in degrees per foot of chamber length. Referring to the data just above For chambers with the 3 degree angling capability at each joint the curve factor is increased from about 0.45 for a 6.25 ft chamber to about 0.72 for a 4 ft chamber. For the ELC chamber range of 4-5 ft, the curve factor in degree/ft is in the range 0.57 to 0.72. The same proportionate effect will be achieved for chambers having other kinds ofjoints with other plus or minus accommodations. For example, if chambers, such as the chamber Q shown in FIG. 4, are adapted to connect with a swivel joint which allows a maximum included angle of plus or minus 10 degrees swing, then use of the ELC invention chambers provides greater total curving in a particular direction, for any given string length. For example a 100 ft string of 4 ft chambers will curve through a maximum total angle A of about 240 degrees, compared to an angle of about 150 degrees for a 100 ft string of 6.25 ft long prior art chambers.

The invention also better accommodates vertical plane variations because of the greater number of joints per unit length of chamber string. There may be inadvertent unevenness in the trench bottom, even though the aim is to make it essentially planar. Most chamber joint configurations typically allow some upward or downward (vertical plane) angling at a joint, while still maintaining a joint which does not allow soil intrusion and still transfers loads as necessary, but there is more constraint than in the horizontal plane. For example, in the commercial chambers relating to the kind of joints shown in U.S. Pat. No. 5,336,017, vertical plane angling of 1-2 degrees can be allowed, while maintaining joint integrity. (Obviously, no misalignment is preferred.) Thus, ELC chambers provide better accommodation for up-down variations, and increase the cumulative vertical plane curving which a given length of chamber string can accommodate. Chamber Q joint design, described below, is inherently more accommodating of vertical angling, and the benefit of the invention is not needed.

Figure 1:
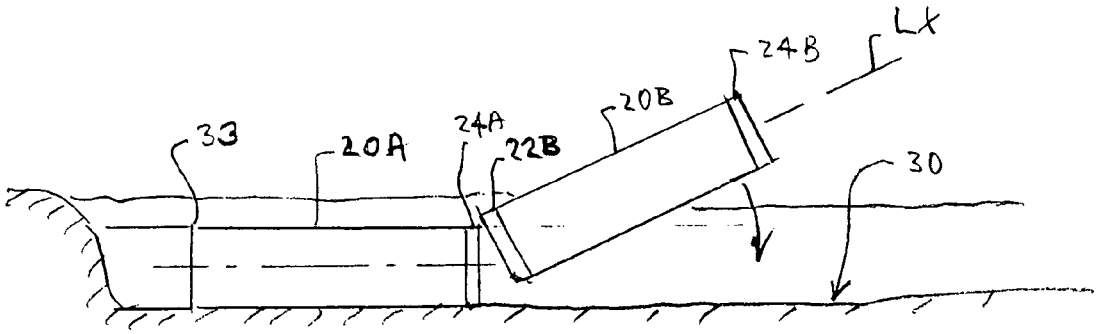
FIG. 1 is a vertical elevation schematic view through a trench in the earth, showing how a second leaching chamber is angled downwardly into the trench, to make a joint and form a string of chambers in the trench.
Figure 2:
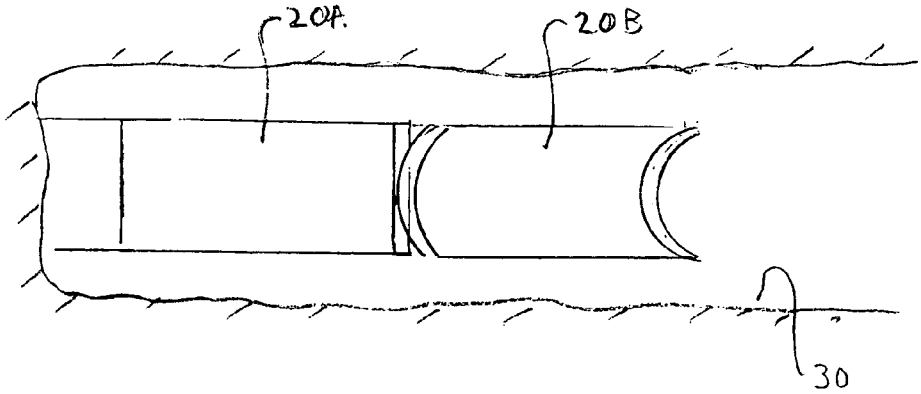
FIG. 2 is a plan view of the trench and chamber shown in FIG. 1.

The time to install a given length of chambers depends in good measure on the ease with which chambers are mated at joints. ELC chambers provide such an improvement, particularly in the chamber Q embodiment. FIG. 1 is a schematic vertical section through a trench 30, showing how chamber joints are made. FIG. 2 is a plan view. The typical procedure is as follows. First chamber 20A is placed flat in the trench 30, so the joint portion at its second end 24A is positioned to receive the first end of a second chamber 20B. Then, the installer (whose presence in the trench should be imagined) lowers the first end 22B of second chamber 20B, so the chamber is on an incline of about 20-45 degrees to the horizontal; and, rests the first end against or on the second end 24A of the first chamber. While maintaining lengthwise pressure, the installer rotates second chamber 20B downwardly, as indicated by the arrow, to make the joint, so that both chambers lie in the bottom of the trench 30 with an interlock joint 33 therebetween.

That process of putting chambers together may seem simple, but experience shows it is not so easy to handle, accurately position, and lower a chamber, especially a prior art chamber configured for essentially linear connection. This is attributable to the combination of weight, width and length of the chamber, compared to the size of the typical person. A typical prior art 6.25 ft×34 inch wide×12-18 inch high chamber weighs about 25-40 pounds. As the second chamber is lowered and becomes more and more oblique, the installer—who is standing in the trench and holding the chamber, ultimately at its second end 24B—moves farther and farther away from the joint, ultimately 6 ft or more. And, during the lowering, the operator often grasps the second chamber off its centerline. The weight of chamber thus imparts a torque and lengthwise bending moment to the chamber, with resultant deflections about the point where the chamber is grasped by the installer and otherwise supported. As an example of torsional flexibility and deflection, the corner of a standard chamber can be lifted vertically more than 22 inch, before the same-side opposing end corner lifts from a flat surface.

The various factors and effects which have been described make it difficult for the installer to perceive how good the partial engagement of the joint is, and to take necessary subtle corrective action. If the chamber is inadvertently twisted when being manipulated, the engagement of the joint features can be lost. So, there is a hesitation and sometimes mis-mating and a need to start the procedure over. If excess dirt is knocked into the trench, it has to be cleaned out.

In the invention, the same method of engaging, angling and lowering is followed, but the chamber length is reduced, preferably to about 4 ft. Field tests show that an installer is able to make any given joint more easily and quickly. So, even though more four foot ELC chambers are required to make a given length of string, the time for installing such given length string can be less.

The invention works and provides a benefit because the chamber size is more ergonomically favorable, in length, aspect ratio and weight, with respect to the size of an installer. This can be understood from the relationship of human factors to the chamber installation situation. Human factors data shows that the median U.S. male is about 68.5 tall; and, the median female is about 64 inch tall. (In feet, those heights are about 5.7 and 5.3 ft, respectively.) See J. H. Burgess, "Designing for Humans," Petrocelli Books, Princeton, N.J. (1986). A person's ability to manipulate things with his or her arms is typically related to his or her height. It is a rule of thumb that the distance between laterally extended fingertips is about the same as a person's height. The further an object is horizontally from the torso, the more the torque on the lumbar spine and lower back. Also, it is notable that the average woman has about one-third the upper body strength of men, making it more important to have a manageably sized load for women and smaller than average size men.

Thus, the prior art difficulty in lifting a nested 6 ft long and 3 ft wide prior art chamber (having an actual overall length of just over 76 inch), and then manipulating the chamber to make a joint can be understood, along with the advantage of the invention. The typical prior art chambers are somewhat more than 10% longer than the median male height, and thus unwieldy. The preferred about 4 ft long ELC chamber is about 70-75% of the median male-female person height. At about 5 ft length or less, ELC chamber will be less than about 100% of the median person height. The exact percentage varies with whether median male or female is being referenced. (To the extent updated statistical data may show the mean height of people to be bigger than the data referenced herein, the percentages and chamber lengths might be increased somewhat within the teaching herein.)

Compared to prior art long chambers, an ELC chamber has reduced weight and its mass is more compactly positioned, relative to the center of mass. For example, a prior art Infiltrator® standard chamber is 6.25 ft long (actual length is about 76.5 inch), weighs about 28 pounds, and all the mass is within 3 ft of the center of mass; whereas a 4 ft long ELC chamber having the same essential construction would weigh about 19 pounds, and all the mass is within 2 ft of the center of mass. Thus, ELC chambers are easier to handle when raised in the air and when twisted, for the typical male or female because they have more favorable relative size, less weight, and a more favorable, less dispersed, mass distribution. Since women on average are somewhat smaller than men, the ELC chamber is even more compelling in advantage for them, as it is for any male installer who is below median height.

Figure 5:
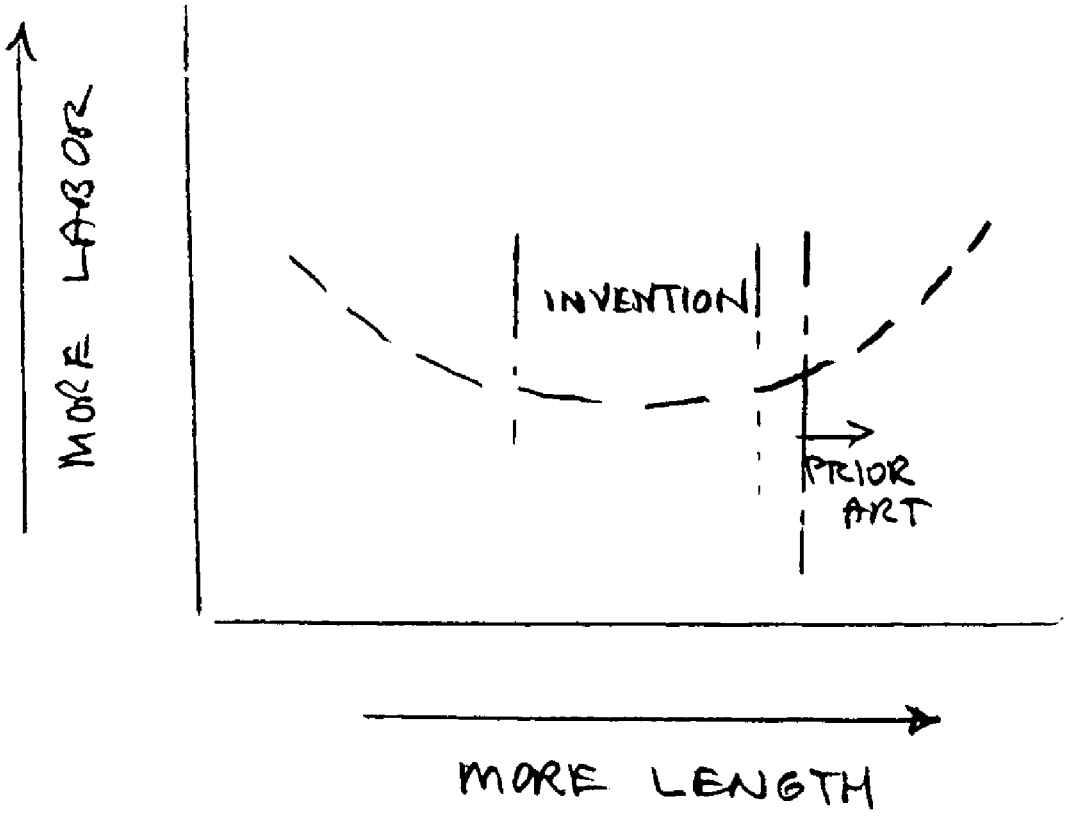
FIG. 5 is a conceptual graph showing the relation between labor of manufacture, handling and installation as a function of chamber length.

ELC chambers of the invention preferably have a length between about 4 and 5 ft. In addition to the foregoing explanation, the unexpected benefits and usefulness of the 4-5 ft length range can be understood from the conceptual relationship between labor involved in handling and installing, represented by the U-shape curve shown in FIG. 5. If chambers are insufficiently short with respect to an installer's size, they are still hard to manipulate, and labor is high, as shown by the right side of the curve. If chambers are very short compared to the installer's median size, although each might be easy to handle, the time and cost of labor is increased because there are so many parts to handle, and too many joints to make. Thus, one factor trades off against the other, and the invention achieves an optimum result. For practical purposes in the field, chamber lengths which provide round number string lengths, such as 25 or 100 ft, are preferred, thus leading to the most preferred length of about 4 ft.

Preferably, a chamber in accord with the present invention is constructed in accord with the teachings about chamber design, construction, and function in patent application Ser. No. 10/677,938 of R. Brochu et al., entitled Corrugated Leaching Chamber, filed on even date herewith, the disclosure of which is hereby incorporated by reference. Such a chamber, employing the ELC length of 4 ft, is marketed as the Quick4™ chamber by Infiltrator Systems of Old Saybrook, Conn., US. It is made by injection molding of thermoplastic, preferably polypropylene or high density polyethylene, and has a weight of just under 12 pounds. Such a chamber is illustrated in FIG. 4, and is designated as Chamber Q in Table 1. Chamber Q has seven peak corrugations 122 running up along a continuous curve arch shaped as a semi-ellipse.

Slot perforations 30 in sidewalls of the peaks 122 and valleys 124 of chamber Q allow percolation of water. The first end 74 of chamber is a relatively plain arch. The second end 76 has a dome shape, to receive end 74 of a second like chamber, and form a joint which will transfer vertical and lengthwise loads, to or from a mated chamber, in a way functionally close to the prior art chambers, while allowing greater angling than heretofore. Chambers are kept from separating at the joints by engagement of molded pin 82, which engages molded pocket 84 of a like chamber when the end 74 of the like chamber is overlapped on end 76. The joints between chambers Q preferably provide for plus or minus 10 degree angling between the lengths of mated chambers. Chamber Q joints are substantially different from the prior art and simpler to make in the trench, but that the installer still has to worry about contacting the side of the trench with the end of the chamber, particularly in view of the flexibility aspect discussed below, so there is a good benefit of the ELC design for chambers Q.

The chamber Q interior and exterior are smooth. That is, the corrugated body section is free of strengthening ribs, which characterize prior art chambers. The sidewalls where there are lengthwise slot perforations 30 are about 0.15-0.2 inch thick, which is thin compared to the prior art chambers. Thus, chambers Q nest more closely and tightly, when stacked one on the other for transport. The basic chamber wall thickness in locations away from the portions having perforations are about 0.09 inch thick.

Chambers Q have low weight per unit length, because of their desirable arch curve, thin walls, and lack of ribs. But, these same characteristics mean the new chambers are substantially less stiff than prior art chambers. In particular chambers Q flex more along the lengthwise axis. Simple beam bending tests show a Quick4 chamber Q has about 8-9 times more deflection for a given load than does an Infiltrator standard chamber. For instance, a 3 ft portion of corrugated body, simply supported on the base flange, deflects about 1.1 inch under a 50 lb vertically down load, compared to about 0.1 inch for an Infiltrator standard chamber. Such deflection is referred to as the flexibility factor. Another comparable popular chamber has a flexibility factor of 0.15. ELC invention chambers of the type Q embodiment have a flexibility factor substantially greater than 0.2 inch, more preferably greater than about 1 inch. Flexibility, or lack of stiffness is not a significant performance factor, after the chamber is buried and in use. But it can be a significant factor when handling and installing the chamber, particularly when the installer grasps the chamber at one location, rotates the chamber and or holds it off-center. Thus, there is an interdependency of short length, or ELC sizing, to compensate for the increased flexibility of chamber Q configuration, and that enhances the feasibility of quick installation.

The aspect ratio of a chamber, as used here, is the ratio of length to width, measured at the base of the arch shape cross section. Chamber width is commonly measured as width of the base flange, which ordinarily extends an inch or two from the bottom of the larger peak arch corrugation. Chambers which are about 34 inch wide may have actual flange-to-flange base dimensions in the range of about 32-36 inch. Small aspect ratios, for instance for chambers which are short but wide make a chamber comparatively and ergonomically better, and easier to install. For example, in a limiting case, it is easier to manipulate round bar of plastic, rather than a standard 6×3×1 ft chamber or other object, where weight and length are equal. Prior art chambers are difficult to handle because of a combination of length and high aspect ratio, in addition to the other relationships mentioned above.

Table 1 provides parametric data for the invention chambers having a "Q" designator, in comparison to some typical prior art chambers. The preferred invention chambers have an aspect ratio of less than 2, more preferably 1.4 or less, and thus more favorable distribution of mass. ELC chamber length is less than about 100 percent, more preferably less than about 80 percent, of the median man height of 68.5 inch. The invention is most applicable to the popular 34 inch wide chamber.

TABLE 1

Parameters of leaching chambers.

| Designation | Length-L inch | Width-W inch | Height inch | Aspect Ratio L/W | Percent of median man height* | Weight/L lb/ft |
|---|---|---|---|---|---|---|
| New Chambers: | | | | | | |
| Q (Quick4) | 48 | 34 | 2-18 | 1.4 | 70 | 2.9 |
| Q1 | 54 | 34 | 12-18 | 1.6 | 79 | 2.8 |
| Q2 | 60 | 34 | 12-18 | 1.8 | 87 | 2.7 |
| Prior Art Chambers: | | | | | | |
| STDHC | 76 | 34 | 12-18 | 2.2 | 110 | 5.6 |
| EQ36 | 101 | 22 | 13.5 | 4.6 | 172 | 3.8 |
| EQ24 | 100 | 15 | 11 | 6.7 | 170 | 2.9 |

*median man height is 68.5 inch

A benefit of the substantially smooth and rib free corrugated shape of the type Q chambers is that chambers nest more compactly than prior art chambers. However, that also makes them are more difficult to separate, if the ends are not lifted evenly, when a chamber is lifted from a nested pile. With the short ELC length configuration, a worker is able to grasp a chamber at both opposing ends, and lift it evenly. As is well known, the finger tip to finger tip distance between an average person's outwardly extended arms is about the same as the person's height. Obviously, when a person grasps something with out-stretched arms, curling of fingers means the length that can be grasped is less than the person's height. Thus, when a chamber is between 4 and 5 ft, preferably about 4 feet, a median height person, or a below median height person, can approach a nested stack of chambers from the side of the stack, and grasp and lift both ends of the chamber simultaneously. That is something that cannot be done with an about 6 ft long chamber.

Another aspect of the invention is that more chamber length can be made per injection molding machine cycle, when using very large injection molding machines which have a platen of about 8 ft square and commensurate mold capacity. (Molds may be slightly larger than platens.) So, two 4 ft long chambers can be made in the same mold space which previously produced only one about 6 ft long chamber. Thus labor cost is reduced at the point of manufacture.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

I claim:

1. A method of manually installing a string of arch shape cross section leaching chambers having sidewalls with a multiplicity of perforations for passage of water, for forming an interconnected string of chambers within a trench in soil; wherein the trench defines the path of said string and has a width sufficient to receive only a single string of chambers connected end-to-end, wherein each chamber has a first end and an opposing second end; wherein the first and second ends of adjacent chambers of the string connect with a load transferring joint; which method comprises the steps of (a) lifting a first chamber from the top of a stack of nested chambers; (b) placing the first chamber in said trench; (c) removing a second chamber from the top of a stack of nested chambers; (d) engaging the first end of the second chamber with the second end of the first chamber by vertically angling the second chamber relative to the first chamber and then lowering the second end of the second chamber into the trench to thereby form said joint between said chambers; wherein the person doing the manual installing stands in the trench and manipulates the second chamber during step (d); wherein the length of each chamber is at least 4 feet and no greater than 5.7 feet; and wherein each chamber has a flexibility factor of greater than about 0.2 inch.

2. The method of claim 1 wherein the lifting step is performed by a single person grasping opposing ends of the chamber.

3. The method of claim 1 wherein the length of each chamber is between about 4 and 5 feet.

4. The method of claim 1 wherein each chamber has a flexibility factor of greater than about one inch.

5. The method of claim 1 wherein each chamber has a length to width aspect ratio between about 1.2 and 2.0, a weight per foot of about 2.7 to 3 pounds.

6. The method of claim 1 wherein each chamber comprises a continuous curve arch shape cross section; and wherein the interior and exterior surfaces are substantially free of ribs; and wherein each chamber has a length to width aspect ratio between 1.2 and 2.0. a weight per foot of about 2.7 to 3 pounds.

7. An arch shape cross section molded thermoplastic leaching chamber comprising:

a first end and a second end; opposing sidewalls with a multiplicity of horizontal slot perforations for passage of water; a length at least 4 feet and no greater than 5.7 feet; a length to width aspect ratio between 1.2 and 2.0; a weight per foot of about 2.7 to 3 pounds; and, a flexibility factor of greater than about 0.2 inch; wherein, a first end of the chamber resists removal from the top of a nested vertical stack of like chambers when only the second end of the chamber is lifted from the stack.

8. The chamber of claim 7 having a width of about 3 feet.

9. The chamber of claim 7 wherein the flexibility factor is at least about 1 inch.

10. A continuous curve arch shape cross section molded thermoplastic corrugated leaching chamber which comprises: interior and exterior surfaces which are substantially free of ribs; opposing sidewalls having a multiplicity of horizontal slot perforations; and, opposing first and second ends shaped for interconnecting with like chambers; wherein the chamber has a flexibility factor of at least 0.2 inch; wherein the chamber has a length at least 4 feet and no greater than 5.7 feet; and, wherein the first end of the chamber resists removal from a nested vertical stack of like chambers when only the second end of the chamber is lifted from the stack.

11. The chamber of claim 10 wherein the flexibility factor is at least 1 inch.

* * * * *